US005956768A

United States Patent [19]

Pearson

[11] Patent Number: 5,956,768

[45] Date of Patent: Sep. 28, 1999

[54] FOOT WARMING POUCH

[76] Inventor: Linda G. Pearson, 846 Posada Way, Fremont, Calif. 94536

[21] Appl. No.: 09/109,699

[22] Filed: Jul. 2, 1998

[51] Int. Cl.[6] ..... A47G 9/02

[52] U.S. Cl. ..... 2/69.5; 2/22; 5/494; 5/485

[58] Field of Search ..... 2/239, 22, 69, 2/61, 69.5, 111; 128/882, 893, 873, 872; 5/494, 485, 497, 486, 482, 658

[56] References Cited

U.S. PATENT DOCUMENTS

| | | | |
|---|---|---|---|
| 633,134 | 9/1899 | Hansen | 2/69 |
| 1,425,952 | 8/1922 | Fidler | 5/485 |
| 1,808,233 | 6/1931 | Kamrath | 2/69 |
| 1,811,821 | 6/1931 | Bloom | 2/69 |
| 2,146,400 | 2/1939 | Maker et al. | 2/69 |
| 2,530,606 | 11/1950 | Farrington | 2/69.5 |
| 2,563,501 | 8/1951 | Sperling | 128/134 |
| 2,642,865 | 6/1953 | McGann, Jr. | 128/134 |
| 2,705,325 | 4/1955 | Bogenberger | 2/69 |
| 2,712,133 | 7/1955 | Coleman | 2/69 |
| 3,093,132 | 6/1963 | Bailey | 2/69.5 |
| 3,497,875 | 3/1970 | Rivera | 2/239 |
| 3,521,309 | 7/1970 | Evans | 5/494 |
| 3,824,640 | 7/1974 | Golden | 5/334 C |
| 3,832,744 | 9/1974 | Krarup | 128/872 |
| 4,627,123 | 12/1986 | Uggerud | 5/485 |

*Primary Examiner*—Amy Vanatta

[57] ABSTRACT

A new foot warming pouch for keeping a sleepers' feet warm while in bed. The inventive device includes a pouch portion having a generally rectangular configuration. The pouch portion includes a back panel and a front panel. The back panel is securable inwardly of a lower edge of a bed sheet. Lower edges and opposed side edges of the back panel and the front panel are secured together to form an upwardly extending neck portion. The neck portion has an open upper end leading into a foot receiving interior of the pouch portion. A front portion of the open upper end has a thick collar extending downwardly therefrom.

13 Claims, 2 Drawing Sheets

FOOT WARMING POUCH

BACKGROUND OF THE INVENTION

1. Field of the Invention

The present invention relates to blankets and more particularly pertains to a new foot warming pouch for keeping a sleepers' feet warm while in bed.

2. Description of the Prior Art

The use of blankets is known in the prior art. More specifically, blankets heretofore devised and utilized are known to consist basically of familiar, expected and obvious structural configurations, notwithstanding the myriad of designs encompassed by the crowded prior art which have been developed for the fulfillment of countless objectives and requirements.

Known prior art blankets include U.S. Pat. No. 4,916,756 to Barrett; U.S. Pat. No. 4,363,141 to Doster; U.S. Pat. No. 1,263,825 to Waugh; U.S. Pat. No. 3,872,524 to Hummel; U.S. Pat. No. 2,989,753 to Burner; Patent No. WO 85/01200 to Uggerud; and Patent No. WO 91/18542 to Hall.

While these devices fulfill their respective, particular objectives and requirements, the aforementioned patents do not disclose a new foot warming pouch. The inventive device includes a pouch portion having a generally rectangular configuration. The pouch portion includes a back panel and a front panel. The back panel is securable inwardly of a lower edge of a bed sheet. Lower edges and opposed side edges of the back panel and the front panel are secured together to form an upwardly extending neck portion. The neck portion has an open upper end leading into a foot receiving interior of the pouch portion. A front portion of the open upper end has a thick collar extending downwardly therefrom.

In these respects, the foot warming pouch according to the present invention substantially departs from the conventional concepts and designs of the prior art, and in so doing provides an apparatus primarily developed for the purpose of keeping a sleepers'feet warm while in bed.

SUMMARY OF THE INVENTION

In view of the foregoing disadvantages inherent in the known types of blankets now present in the prior art, the present invention provides a new foot warming pouch construction wherein the same can be utilized for keeping a sleepers' feet warm while in bed.

The general purpose of the present invention, which will be described subsequently in greater detail, is to provide a new foot warming pouch apparatus and method which has many of the advantages of the blankets mentioned heretofore and many novel features that result in a new foot warming pouch which is not anticipated, rendered obvious, suggested, or even implied by any of the prior art blankets, either alone or in any combination thereof.

To attain this, the present invention generally comprises a pouch portion having a generally rectangular configuration. The pouch portion includes a back panel and a front panel. The back panel is securable inwardly of a lower edge of a bed sheet. Lower edges and opposed side edges of the back panel and the front panel are secured together to form an upwardly extending neck portion. The neck portion has an open upper end leading into a foot receiving interior of the pouch portion. A front portion of the open upper end has a thick collar extending downwardly therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new foot warming pouch apparatus and method which has many of the advantages of the blankets mentioned heretofore and many novel features that result in a new foot warming pouch which is not anticipated, rendered obvious, suggested, or even implied by any of the prior art blankets, either alone or in any combination thereof.

It is another object of the present invention to provide a new foot warming pouch which may be easily and efficiently manufactured and marketed.

It is a further object of the present invention to provide a new foot warming pouch which is of a durable and reliable construction.

An even further object of the present invention is to provide a new foot warming pouch which is susceptible of a low cost of manufacture with regard to both materials and labor, and which accordingly is then susceptible of low prices of sale to the consuming public, thereby making such foot warming pouch economically available to the buying public.

Still yet another object of the present invention is to provide a new foot warming pouch which provides in the apparatuses and methods of the prior art some of the advantages thereof, while simultaneously overcoming some of the disadvantages normally associated therewith.

Still another object of the present invention is to provide a new foot warming pouch for keeping a sleepers' feet warm while allowing ease of mobility and the exit of feet to prevent overheating.

Yet another object of the present invention is to provide a new foot warming pouch which includes a pouch portion having a generally rectangular configuration. The pouch portion includes a back panel and a front panel. The back panel is securable inwardly of a lower edge of a bed sheet. Lower edges and opposed side edges of the back panel and the front panel are secured together to form an upwardly extending neck portion. The neck portion has an open upper end leading into a foot receiving interior of the pouch portion. A front portion of the open upper end has a thick collar extending downwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
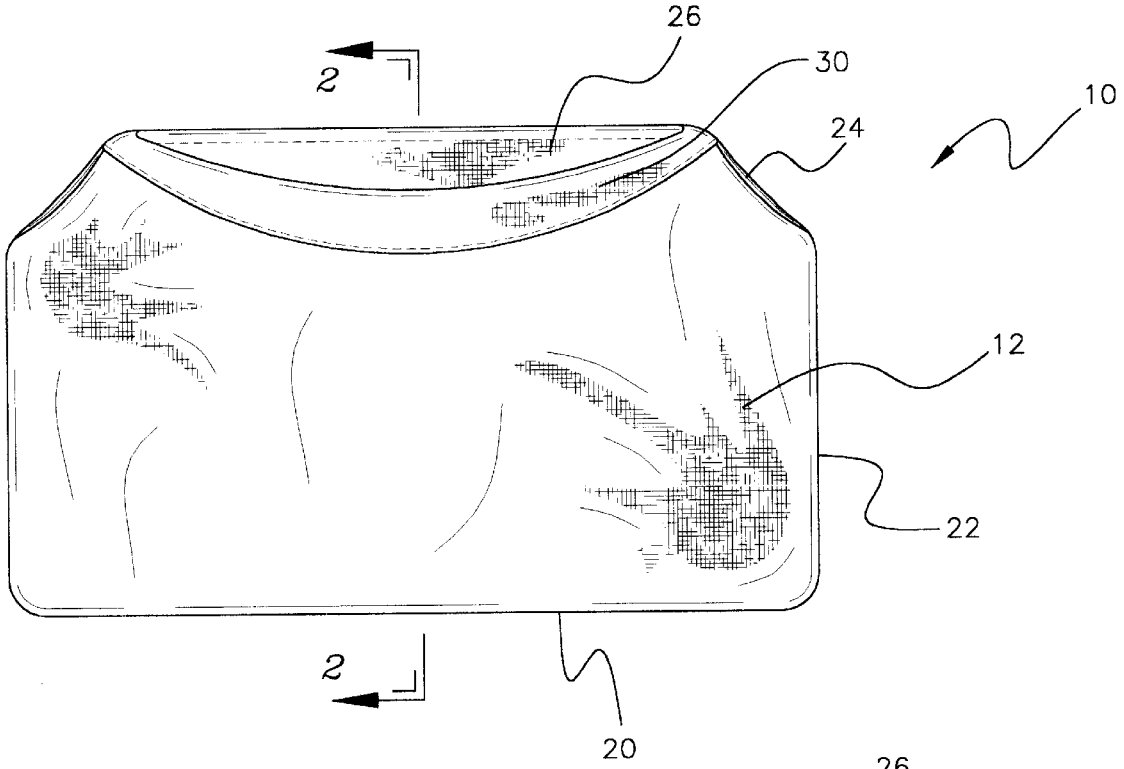
FIG. 1 is a top plan view of a new foot warming pouch according to the present invention.
Figure 2:
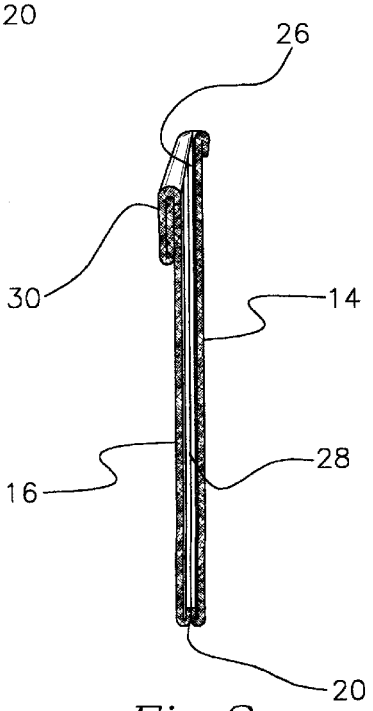
FIG. 2 is a cross-sectional view of the present invention as taken along line 2—2 of FIG. 1.
Figure 3:
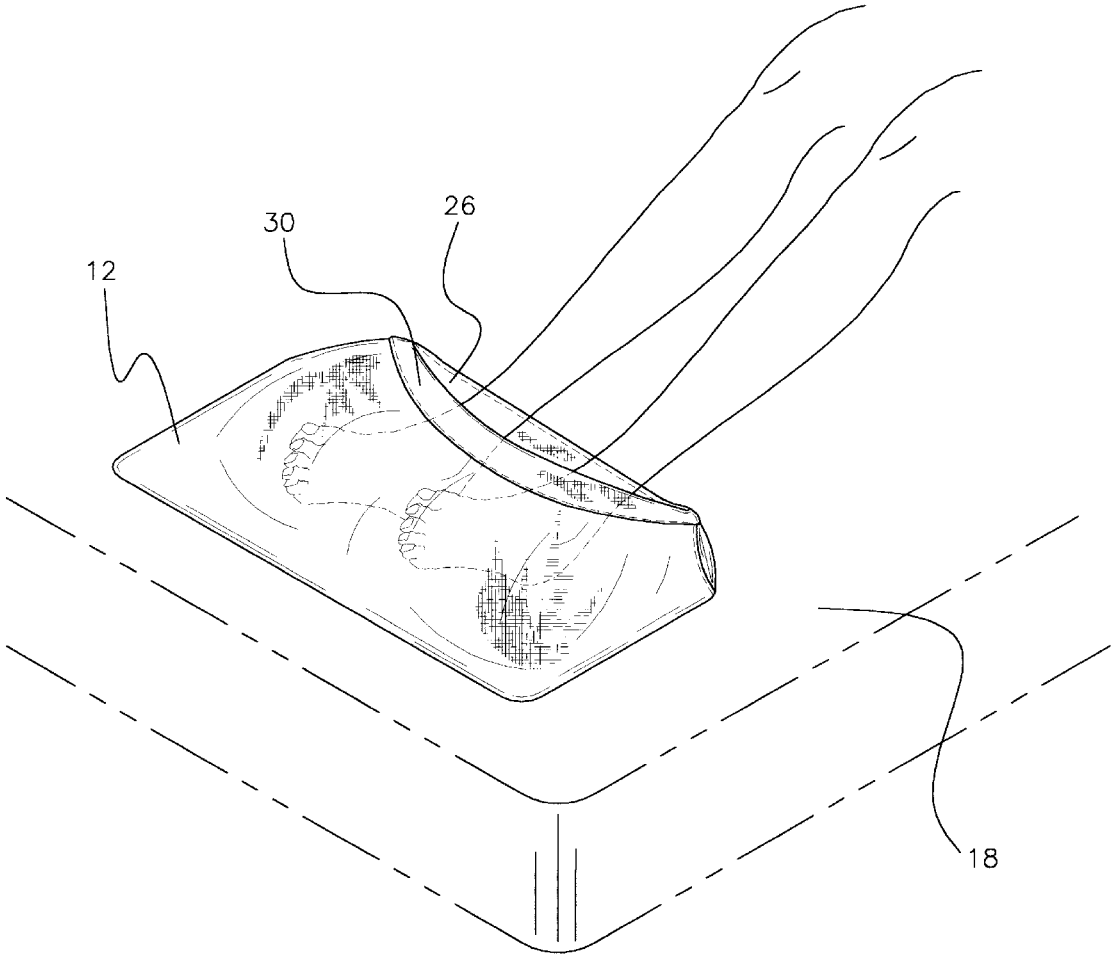
FIG. 3 is a perspective view of the present invention illustrated in use.

With reference now to the drawings, and in particular to FIGS. 1 through 3 thereof, a new foot warming pouch embodying the principles and concepts of the present invention and generally designated by the reference numeral 10 will be described.

As best illustrated in FIGS. 1 through 3, the foot warming pouch 10 comprises a pouch portion 12 having a generally rectangular configuration. The pouch portion 12 includes a back panel 14 and a front panel 16. The back panel 14 is securable inwardly of a lower edge of a bed sheet 18. The bed sheet 18 could be either a fitted sheet or a flat sheet. The positioning of the pouch portion 12 at the lower portion of the bed sheet 12 allows for a user to place their feet therein with a choice of any leg position. The pouch portion 12 could be incorporated into the bed sheet or could be provided with means for removable securement. Such means could be a tie attachment, a cord, or a clip. Hook and loop fasteners could also be employed. Lower edges 20 and opposed side edges 22 of the back panel 14 and the front panel 16 are secured together to form an upwardly extending neck portion 24. The neck portion 24 has an open upper end 26 leading into a foot receiving interior 28 of the pouch portion 12. A front portion of the open upper end 26 has a thick collar 30 extending downwardly therefrom. The thick collar 30 is formed from an upper edge of the front panel 16 being twice folded. The thick collar 30 is arcuate between the side edges of the front panel 16. The thick collar 30 curves downwardly towards the lower edge of the front panel 16.

A back portion of the open upper end 26 has a narrow collar extending downwardly therefrom along an outer surface thereof. The narrow collar is formed from an upper edge of the back panel 14 being once folded. The narrow collar is substantially straight when lying on a plane extending across the back panel 14.

The neck portion 24 tapers together towards the open upper end 26. The lower edges and side edges of the front 16 and back 14 panels are folded inwardly such that they extend into the pouch 12 and neck 24 portions. A width of the pouch portion 12 extends parallel to the lower edges of the front 16 and back 14 panels and is defined between the side edges of the front and back panels. A length of the pouch portion 12 extends parallel to the side edges of the front and back panels and is defined between the lower edges of the front and back panels and the neck portion 24. The length of the pouch portion 12 is less than about half the width of the pouch portion. A length of the neck portion 24 is defined along the upper portions of the opposed side edges of the front and back panels between the open upper end and a bend formed where the neck portion begins to taper towards the open upper end. The length of the pouch portion 12 is less than about half the width of the pouch portion. The length of the neck portion 24 is less than about half the length of the pouch portion 12.

In use, the present invention is an accessory designed to be used with standard bedding to provide added comfort for sleepers, specifically to keep their feet warm.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A foot warming pouch for keeping a sleepers' feet warm while in bed comprising, in combination:

a pouch portion having a generally rectangular configuration, the pouch portion including a back panel and a front panel secured together at lower edges and opposed side edges thereof, the back panel being coupled to a bed sheet inwardly of a lower edge of the bed sheet, upper portions of the opposed side edges of the back panel and the front panel being secured together to form an upwardly extending neck portion, the neck portion having an open upper end leading into a foot receiving interior of the pouch portion, a front portion of the open upper end having a thick collar extending downwardly therefrom along an outer surface thereof; and the thick collar being arcuate between the side edges of the front panel, the thick collar curving downwardly towards the lower edge of the front panel.

2. The foot warming pouch as set forth in claim 1 wherein the pouch portion is dimensioned for receiving one set of feet therein.

3. The foot warming pouch as set forth in claim 1 wherein the pouch portion is dimensioned for receiving at least one set of feet therein.

4. The foot warming pouch as set forth in claim 1 further comprising a bed sheet adapted for resting on a mattress, the pouch portion being fixedly coupled to the bed sheet.

5. The foot warming pouch as set forth in claim 1 further comprising a bed sheet adapted for resting on a mattress, the pouch portion being removably coupled to the bed sheet.

6. The foot warming pouch as set forth in claim 1 wherein the thick collar is formed from an upper edge of the front panel being twice folded.

7. The foot warming pouch as set forth in claim 1 wherein a back portion of the open upper end has a narrow collar extending downwardly therefrom along an outer surface thereof, wherein the narrow collar is formed from an upper edge of the back panel being once folded.

8. The foot warming pouch as set forth in claim 7 wherein the narrow collar is substantially straight when lying on a plane extending across the back panel.

9. The foot warming pouch as set forth in claim 1 wherein the neck portion tapers together towards the open upper end.

10. The foot warming pouch as set forth in claim 1 wherein the lower edges and side edges of the front and back panels are folded inwardly such that they extend into the pouch and neck portions.

11. The foot warming pouch as set forth in claim 1 wherein a width of the pouch portion extends parallel the lower edges of the front and back panels and being defined between the side edges of the front and back panels, a length of the pouch portion extending parallel the side edges of the front and back panels and being defined between the lower edges of the front and back panels and the neck portion, wherein the length of the pouch portion is less than about half the width of the pouch portion.

12. The foot warming pouch as set forth in claim 11 wherein a length of the neck portion being defined along the upper portions of the opposed side edges of the front and back panels between the open upper end and a bend formed where the neck portion begins to taper towards the open upper end, wherein the length of the pouch portion is less than about half the width of the pouch portion, wherein the length of the neck portion is less than about half the length of the pouch portion.

13. A foot warming pouch for keeping a sleepers' feet warm while in bed comprising, in combination:

a bed sheet adapted for resting on a mattress;

a pouch portion having a generally rectangular configuration, the pouch portion including a back panel and a front panel secured together at lower edges and opposed side edges thereof, the back panel being fixedly coupled to the bed sheet inwardly of a lower edge of the bed sheet, upper portions of the opposed side edges of the back panel and the front panel being secured together to form an upwardly extending neck portion, the neck portion having an open upper end leading into a foot receiving interior of the pouch portion, a front portion of the open upper end having a thick collar extending downwardly therefrom along an outer surface thereof;

wherein the thick collar is formed from an upper edge of the front panel being twice folded;

a back portion of the open upper end having a narrow collar extending downwardly therefrom along an outer surface thereof, wherein the narrow collar is formed from an upper edge of the back panel being once folded;

the thick collar being arcuate between the side edges of the front panel, the thick collar curving downwardly towards the lower edge of the front panel;

the narrow collar being substantially straight when lying on a plane extending across the back panel;

wherein the neck portion tapers together towards the open upper end;

wherein the lower edges and side edges of the front and back panels are folded inwardly such that they extend into the pouch and neck portions a width of the pouch portion extending parallel the lower edges of the front and back panels and being defined between the side edges of the front and back panels, a length of the pouch portion extending parallel the side edges of the front and back panels and being defined between the lower edges of the front and back panels and the neck portion, a length of the neck portion being defined along the upper portions of the opposed side edges of the front and back panels between the open upper end and a bend formed where the neck portion begins to taper towards the open upper end;

wherein the length of the pouch portion is less than about half the width of the pouch portion; and wherein the length of the neck portion is less than about half the length of the pouch portion.

* * * * *